US006976522B2

(12) United States Patent
Strand

(10) Patent No.: US 6,976,522 B2
(45) Date of Patent: Dec. 20, 2005

(54) VENETIAN BLIND LADDER DRUM AND METHOD OF ASSEMBLING VENETIAN BLIND

(75) Inventor: Toralf H. Strand, Madison, WI (US)

(73) Assignee: Springs Window Fashions LP, Middleton, WI (US)

( * ) Notice: Subject to any disclaimer, the term of this patent is extended or adjusted under 35 U.S.C. 154(b) by 0 days.

(21) Appl. No.: 10/442,378

(22) Filed: May 21, 2003

(65) Prior Publication Data

US 2004/0231807 A1 Nov. 25, 2004

(51) Int. Cl.[7] ..... E06B 9/26

(52) U.S. Cl. ..... 160/176.1 R; 160/168.1 R; 160/178.2 R

(58) Field of Search ..... 160/176.1 R, 168.1 R, 160/170 R, 171 R, 173 R, 174 R, 177 R, 160/178.2 R, 178.3 R

(56) References Cited

U.S. PATENT DOCUMENTS

| | | | | |
|---|---|---|---|---|
| 2,495,888 A | | 1/1950 | Burns | |
| 2,579,144 A | | 12/1951 | Griesser | |
| 2,667,220 A | | 1/1954 | Rutledge | |
| 2,701,012 A | | 2/1955 | Loucony | |
| 2,709,488 A | | 5/1955 | Lorentzen | |
| 2,738,005 A | | 3/1956 | Nisenson | |
| 2,758,644 A | | 8/1956 | Virlouvet | |
| 2,928,461 A | | 3/1960 | Barrett | |
| 3,141,497 A | | 7/1964 | Griesser | |
| 3,260,302 A | | 7/1966 | Griesser | |
| 3,269,453 A | | 8/1966 | Vecchiarelli et al. | |
| 3,630,264 A | | 12/1971 | Debs et al. | |
| 3,921,695 A | | 11/1975 | Debs | |
| 4,088,171 A | | 5/1978 | Schluep et al. | |
| 4,200,135 A | * | 4/1980 | Hennequin | 160/168.1 R |
| 4,214,622 A | | 7/1980 | Debs | |
| 4,224,974 A | | 9/1980 | Anderson et al. | |
| 4,262,728 A | | 4/1981 | Debs | |
| 4,484,612 A | | 11/1984 | Vecchiarelli | |
| 4,494,593 A | | 1/1985 | Fielder, Jr. | |
| 4,541,468 A | | 9/1985 | Anderson | |
| 4,697,629 A | | 10/1987 | Anderson | |
| 4,697,630 A | | 10/1987 | Rude | |
| 4,719,955 A | | 1/1988 | Tachikawa et al. | |
| 4,762,161 A | | 8/1988 | Anderson | |
| 4,821,789 A | * | 4/1989 | Van Rens | 160/176.1 R |
| 4,917,168 A | | 4/1990 | Chen | |
| 4,945,971 A | | 8/1990 | Ivarsson et al. | |
| 4,955,421 A | | 9/1990 | Torti | |
| 5,074,349 A | * | 12/1991 | Yannazzone | 160/177 R |
| 5,092,382 A | | 3/1992 | Fluckiger | |
| 5,123,472 A | | 6/1992 | Nagashima et al. | |
| 5,139,073 A | * | 8/1992 | Opdahl et al. | 160/177 R |
| D329,350 S | | 9/1992 | Jian | |
| D335,059 S | | 4/1993 | Schaefer et al. | |
| 5,267,598 A | * | 12/1993 | Marocco | 160/177 R |
| 5,341,865 A | | 8/1994 | Fraser et al. | |

(Continued)

FOREIGN PATENT DOCUMENTS

| | | |
|---|---|---|
| DE | 263 311 | 7/1968 |

(Continued)

*Primary Examiner*—Bruce A. Lev
(74) *Attorney, Agent, or Firm*—Lerner, David, Littenberg, Krumholz & Mentlik, LLP

(57) ABSTRACT

A ladder drum for a venetian blind, a venetian blind assembly utilizing a ladder drum and a method of assembling a venetian blind. The ladder drum includes pairs of slots for securing ladder lace cords. Each pair of slots includes a first slot that retains but does not grip the cord and a second slot for gripping the cord.

34 Claims, 4 Drawing Sheets

U.S. PATENT DOCUMENTS

| | | | | | |
|---|---|---|---|---|---|
| 5,538,068 | A | * | 7/1996 | Liu | 160/177 R |
| 5,573,052 | A | | 11/1996 | Liu | |
| 5,628,356 | A | | 5/1997 | Morocco | |
| 5,638,882 | A | | 6/1997 | Morris | |
| 5,645,685 | A | | 7/1997 | Furhman | |
| 5,662,154 | A | | 9/1997 | Drake, III | |
| 5,799,715 | A | | 9/1998 | Biro et al. | |
| 5,908,062 | A | | 6/1999 | Fun | |
| 5,921,306 | A | * | 7/1999 | Smederod | 1/1 |
| 6,012,506 | A | | 1/2000 | Wang et al. | |
| 6,116,323 | A | | 9/2000 | Huang | |
| 6,129,131 | A | | 10/2000 | Colson | |
| 6,189,596 | B1 | * | 2/2001 | Chen | 160/176.1 R |
| RE37,143 | E | | 4/2001 | Liu | |
| 6,279,642 | B1 | * | 8/2001 | Liu | 160/177 R |
| 6,299,115 | B1 | | 10/2001 | Kovach et al. | |
| 6,302,182 | B1 | | 10/2001 | Anderson | |
| 6,302,183 | B1 | | 10/2001 | Judkins et al. | |
| 6,321,820 | B1 | * | 11/2001 | Liu | 160/177 R |
| 6,527,034 | B1 | * | 3/2003 | Liu | 160/177 R |
| 6,622,770 | B1 | * | 9/2003 | Tyner | 160/178.1 R |

FOREIGN PATENT DOCUMENTS

| | | | | |
|---|---|---|---|---|
| DK | 158 259 | | 3/1957 | |
| GB | 765 419 | | 1/1957 | |
| GB | 1 081 975 | | 9/1967 | |
| IT | 598 222 | | 9/1959 | |
| WO | WO-91/14848 | | 10/1991 | |
| WO | 96/27727 | * | 9/1996 | 160/176.1 R |

* cited by examiner

VENETIAN BLIND LADDER DRUM AND METHOD OF ASSEMBLING VENETIAN BLIND

FIELD OF THE INVENTION

This invention relates to a ladder drum for a venetian blind, a venetian blind including a ladder drum, and a method of assembling a venetian blind.

BACKGROUND OF THE INVENTION

Venetian blinds typically comprise a plurality of horizontal slats suspended beneath a headrail by two or more flexible ladder laces. The ladder laces each include a pair of vertically extending side cords interconnected by a plurality of vertically spaced slat supporting rungs, and the upper ends of the ladders are attached to a ladder drum or tilt drum to tilt the slats in response to turning of the ladder drum. Carriers for the several ladders typically are rotated in unison by a tilt rod.

Many ladder drums require the cords of the ladder lace to be tied to the ladder drum. Alternatively, knots or beads are formed on the ends of the cords to provide a stop to secure the cord to the ladder drum. Ladder drums have been provided that do not require the ends of the cords to be tied to the drum or for knots or beads to be formed on the end of the cords to retain the cords on the drum. However, some of these ladder drums are fabricated from multiple pieces, complicating the blind assembly process. It would be desirable to provide a ladder drum and method that simplifies the assembly of venetian blinds.

SUMMARY OF THE INVENTION

In accordance with a first embodiment of the present invention a ladder drum for securing venetian blind ladder lace cords is provided. The ladder drum comprises a unitary main body, the main body being substantially cylindrical in shape and a pair of slots in main body, each pair of slots adapted to secure a ladder lace cord and each pair of slots including a first slot for retaining one of the cords without gripping the cord and a second slot spaced apart from the second slot and sized to grip the cord. In certain embodiments, the first slot is a wide slot and the second slot is a narrow slot. According to some embodiments, the main body includes an inner body and an out body, the inner body having axial ends and an axially extending bore adapted to receive a blind tilt shaft. According to some embodiments, a web extends radially from the inner body to at least a semi-cylindrical outer body extending substantially concentrically around a first portion of the inner body and defining a central region, axial ends, a first side and a second side. A substantially planar surface extends between the first side and second side, and a pair of slots is in each of the first and second sides of the planar surface. Each pair of slots adapted to secure a ladder lace cord and includes a wide slot for retaining one of the cords without gripping the cord and a narrow slot spaced apart from the wide slot and sized to grip the cord.

In another embodiment of the invention, a venetian blind is provided comprising a longitudinally extending headrail for supporting the blind, a drum support, a ladder drum, a ladder lace and a tilt shaft. The drum support is attached to the headrail and has two spaced apart walls for supporting a substantially cylindrical ladder drum. The ladder lace includes two vertically orientated cords attached to the drum so that the cords extend downwardly from the ladder drum and rungs extending between the ladder cords to support slats of the blind. The tilt shaft extends axially and is disposed such that rotation of the shaft rotates the drum, causing one of the ladder cords to be raised and the other ladder cord to be lowered from a neutral position. The ladder drum has a pair of slots and a bore adapted to receive the tilt shaft, each pair of slots adapted to grip a first or second ladder cord and each pair of slots including a first slot for retaining one of the cords without gripping the cord and a second slot spaced apart from the first slot and sized to grip the cord.

In accordance with still another embodiment of the invention, a method of assembling a venetian blind is provided that comprises providing a longitudinally extending headrail for supporting the blind, mounting a ladder drum support to the headrail, the ladder drum support having two spaced apart walls for supporting a substantially cylindrical ladder drum, the ladder drum having a pair of slots and a bore adapted to receive the tilt shaft, each pair of slots adapted to grip a first or second ladder cord and each pair of slots including a first slot for retaining one of the cords without gripping the cord and a second slot spaced apart from the wide slot and sized to grip the cord. In certain embodiments, the first slot is a wide slot and the second slot is a narrow slot. The method further comprises inserting an axially extending tilt shaft through a bore in a central portion of the ladder drum, such that rotation of the shaft rotates the drum, causing one of the ladder cords to be raised and the other ladder cord to be lowered from a neutral position. A ladder is provided including two vertically orientated cords and rungs extending between the ladder cords to support slats of the blind and attaching the cords to the drum so that the cords extend downwardly from the ladder drum.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figure 2:
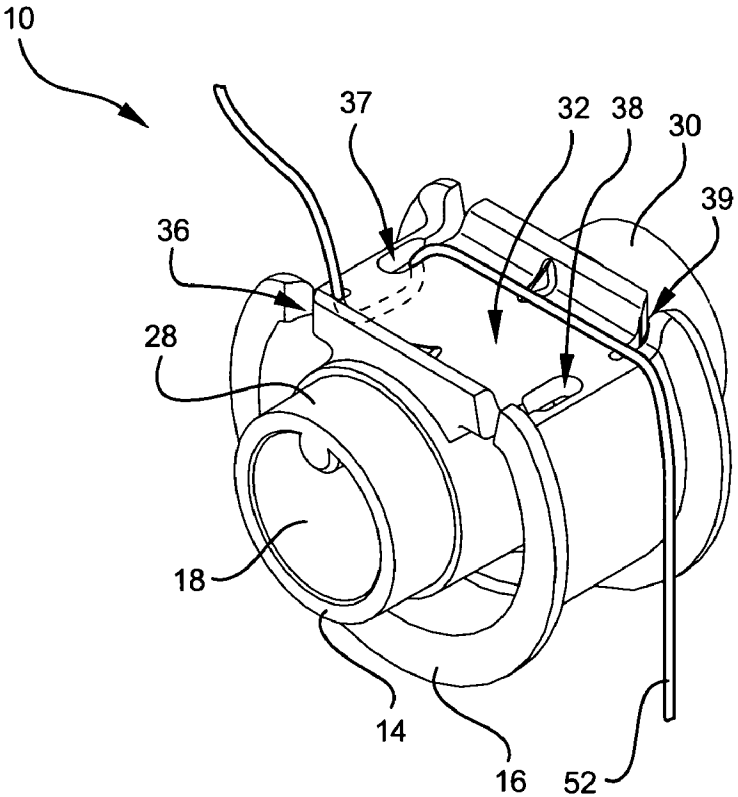
FIG. 2 is a perspective view of a cord threaded through a pair of slots in a ladder drum according to one embodiment.
Figure 1:
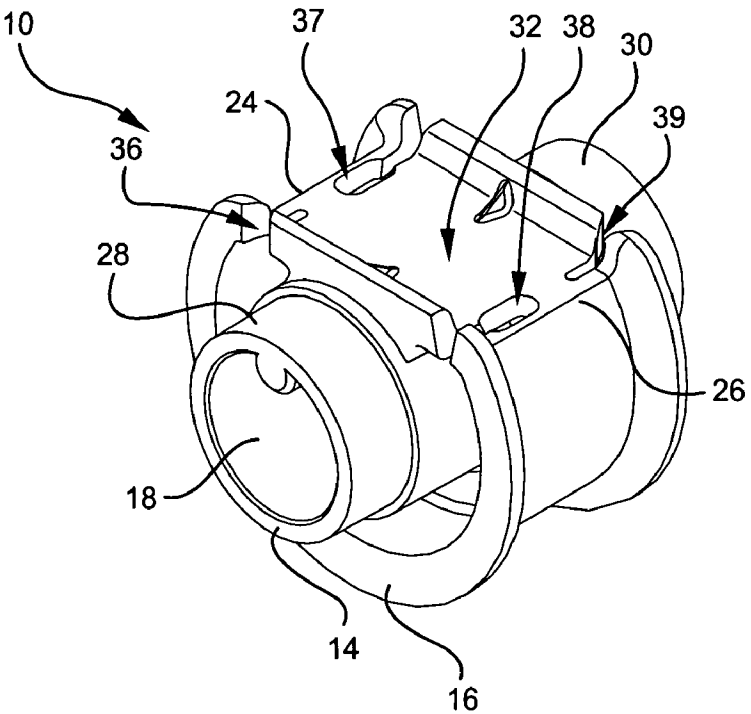
FIG. 1 is a perspective view of a ladder drum for securing the cords of a venetian blind ladder lace according to one embodiment of the present invention.
Figure 3:
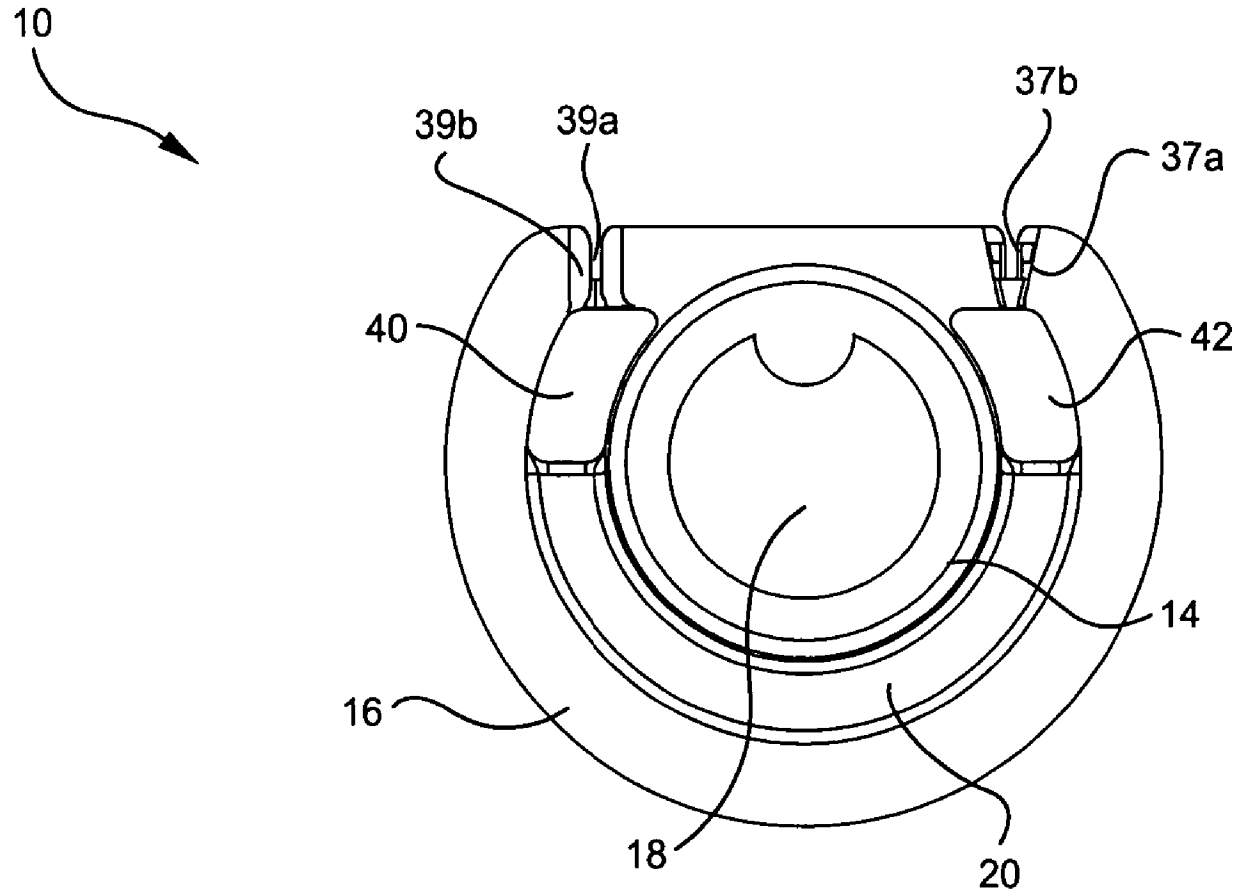
FIG. 3 is an end view of the ladder drum shown in FIG. 1.
Figure 5:
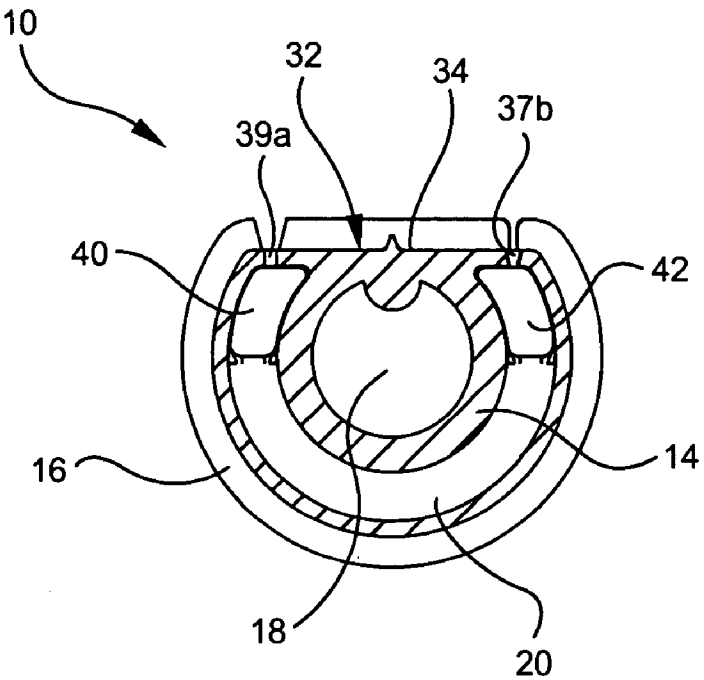
FIG. 5 is a cross-sectional view of taken along line 5—5 of FIG. 4.

Before describing several exemplary embodiments of the invention, it is to be understood that the invention is not limited to the details of construction or process steps set forth in the following description. The invention is capable of other embodiments and of being practiced or carried out in various ways.

Turning now to the drawings and particularly to FIGS. 1–5, a ladder drum 10 for securing venetian blind ladder lace cords 52, 54 is shown. According to a first embodiment, the ladder drum 10 comprises a unitary main body. In certain embodiments, the main body includes a substantially cylindrical inner body 14, having axial ends 28, 30 and an outer body 16, the inner body 14 having an axially extending 18 bore adapted to receive a conventional blind tilt shaft 55 (shown phantom in FIG. 6). As used herein, "substantially cylindrical" means that the drum may be in the form of a cylinder or slightly deformed to have an elliptical cross-section. Preferably, however, the drum is cylindrical. The ladder drum 10 further includes a web 20 extending radially from the inner body 14 to at least a semi-cylindrical outer body 16 extending substantially concentrically around a first portion of the inner body 14. The outer body 16 preferably is at least hemi-cylindrical and defines a first side 24, a second side 26, axial ends 28, 30 and provides substantially planar surface 32 extending between the first side 24 and the second side 26 of the outer body 16. The planar surface 32 includes a central region 34 between the first side 24 and the second side 26. The tilt drum is preferably made from plastic and can be made by conventional manufacturing methods such as injection molding. Other suitable materials such as metal could also be used to form the tilt drum.

There is a pair of slots 36, 37 and 38, 39 in the main body, and preferably in each of the first and second sides of the planar surface 32. Each of the pair of slots cooperates to secure a ladder lace cord. Each pair of slots includes a first slot 37, 38 for retaining one of the cords without gripping the cord and a second slot 36, 39 spaced apart from the first slot and sized to firmly grip the cord. In preferred embodiments, the first slot of each pair is a wide slot and the second slot of each pair is a narrow slot. Preferably, the slots 36, 37, 38, 39 extend in an axial direction parallel to the direction of the bore through which the tilt rod 55 is inserted and are open on the axial ends of the planar surface. In addition, it is preferred that the slots are positioned such that when a pair of cords is secured in their respective slots, the cords do not contact each other and are spaced apart. In a preferred embodiment, the ladder drum web includes openings 40, 42 adjacent the slots on the first side and second side of the planar surface. The function of the openings will be described in more detail below.

Figure 4:
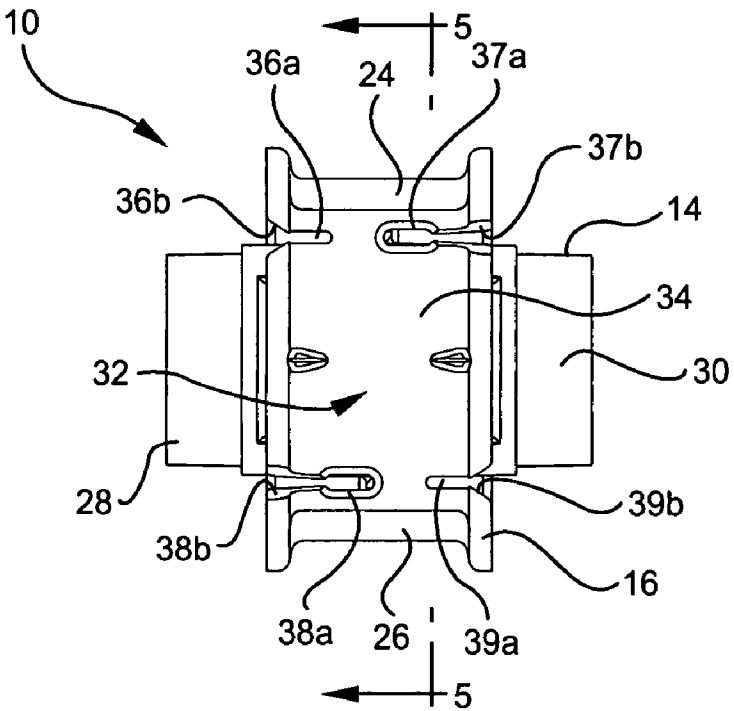
FIG. 4 is a top perspective view of the ladder drum shown in FIG. 1.

As seen in FIG. 4, each first slot 37, 38 preferably includes an oval-shaped portion 37*a*, 38*a* located between the central region 34 of the planar surface 32 and the axial ends of the drum. The oval shaped portions 37*a*, 38*a* are respectively contiguous with axially extending, tapered open portions 37*b*, 38*b* that are narrower than the oval shaped portions. The tapered, open portions 37*b*, 38*b* in the first slots 37, 38 allow a cord end to be passed through the tapered opening and to enter the slot 37, 38. Each second slot 36, 39 includes an oval-shaped portion 36*a*, 39*a* sized to grip the cord and an axially extending tapered, open portion 36*b*, 39*b* sized to allow the cord to enter the second slot. It will be appreciated that the size of the slots and their respective open portions will depend on the size of the cord used to fabricate the blind, and a skilled artisan can select the proper size slot and open portions to secure the cord to the drum.

Figure 6:
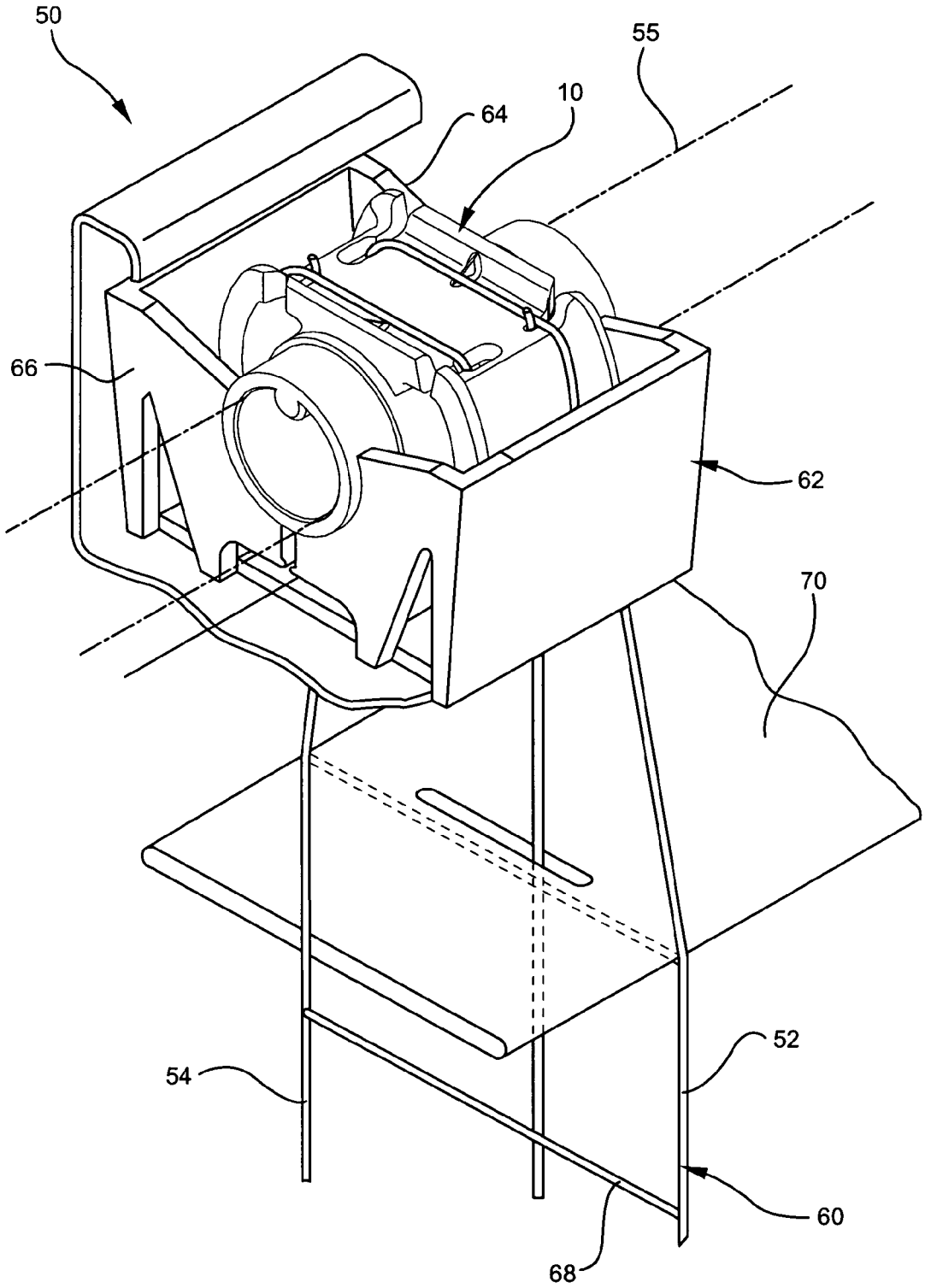
FIG. 6 is a partial perspective view of a portion of a headrail and venetian blind incorporating a ladder drum according to one embodiment.

According to another embodiment shown in FIG. 6, a venetian blind assembly 50 is provided comprising a conventional longitudinally extending headrail 58 for supporting the blind, a conventional ladder lace 60, a drum support 62 for supporting a ladder drum 10 of the type shown in FIGS. 1–5, and a conventional tilt shaft 55 inserted through a central portion of the ladder drum. The drum support 62 is attached to the headrail 56 and has two spaced apart walls 64, 66 for supporting the ladder drum. Preferably, the spaced apart walls 64, 66 allow the ladder drum to rotate in the drum support 62 to allow the blinds to be opened and closed. The ladder lace 62 includes two vertically orientated cords 52, 54 attached to the drum 10 so that the cords extend downwardly from the ladder drum and a plurality of rungs 68 extend between the ladder cords 52, 54 to support slats 70 of the blind 50. A conventional tilt shaft 55 extends axially and is disposed such that rotation of the shaft 55 rotates the drum 10, causing one of the ladder cords to be raised and the other ladder cord to be lowered from a neutral position. This movement of the ladder cord causes tilting of the slats supported in the rungs. The ladder drum 10 has a pair of slots for securing the cords and a bore adapted to receive the tilt shaft. Each pair of slots includes a wide slot for retaining one of the cords without gripping the cord and a narrow slot spaced apart from the wide slot and sized to grip the cord.

According to another embodiment of the invention, a method of assembling a venetian blind is provided. According to the method, a conventional longitudinally extending headrail 56 for supporting the blind is provided, and a ladder drum support 62 is mounted to the headrail 56. The ladder drum support 62 retains a ladder drum of the type described above with respect to FIGS. 1–5. A conventional axially extending tilt shaft 55 is inserted through a bore in a central portion of the ladder drum, such that rotation of the shaft rotates the drum, causing one of the ladder cords to be raised and the other ladder cord to be lowered from a neutral position. The method further comprises providing a conventional ladder lace 60 including two vertically orientated cords and rungs 68 extending between the ladder cords 52, 54 to support slats 70 of the blind and attaching ends of the cords to the drum having at least a pair of slots so that the cords extend downwardly from the ladder drum.

In a preferred embodiment and as best illustrated in FIGS. 2 and 6, each cord is fastened to the drum by moving an end of the cord into one of the first, preferably wide, slots and directing the end of the cord towards the inner body, moving the drum with respect to the cord to position the cord on the drum. The oval portion of the wide slot is sized and shaped so that the ladder cord is free to slide through the wide slot, while the tapered, open portion prevents the cord from slipping out of the wider slot. Once positioned, the end of the ladder cord is moved through one of the openings 40, 42 in the web, and then the cord is moved upwardly into the corresponding second, preferably narrow, slot. The end of the cord enters the narrow slot by pulling the cord against the tapered, open portion of the narrow slot and applying tension to the cord until it locks into the narrow slot, which is sized to grip the ladder cord and lock the ladder cord on the drum. When locked on the drum, the end of the ladder cord protrudes from the planar surface on the outer body of the drum. The cord extends through an opening in the web on the same side of the outer body, through the large slot on the same side of the outer body and then across the planar surface between the first and second sides, around the outer part of the ladder drum, toward the slats. For each wide slot, the tapered open portion is sized to trap the ladder cord within the wider oval portion. The openings between the web and the inner cylinder are disposed beneath the slots. Preferably, the cord is threaded through one of the adjacent openings 40, 42 in the web prior to securing the cord in the narrow slot. When the cord is installed on the drum, the cord is disposed in the wider slot at one location on the cord and disposed in the narrower slot at another location on the cord.

Although the invention herein has been described with reference to particular embodiments, it is to be understood that these embodiments are merely illustrative of the principles and applications of the present invention. Modifications may be made to the ladder drum. For example, the wider slots do not necessarily require tapered, open portions, and it may be desirable for the wider slot to be closed such that the end of the cord is threaded through the wider slots. In addition, the ladder drum may be a single substantially cylindrical body having a central web for receiving the tilt shaft, and the planar surface may be eliminated in certain embodiments. It is therefore to be understood that numerous modifications may be made to the illustrative embodiments and that other arrangements may be devised without departing from the spirit and scope of the present invention as defined by the appended claims and their equivalents.

What is claimed is:

1. A ladder drum for securing venetian blind ladder lace cords comprising:

a unitary main body adapted to receive a blind tilt shaft; and a pair of slots in the main body, the pair of slots adapted to secure a ladder lace cord and the pair of slots including a first slot for retaining one of the cords without gripping the cord and a second slot spaced apart from the first slot and sized to grip the cord, the slots being configured to route the cord through the slots and to lock the cord to the drum without contacting the tilt shaft.

2. The ladder drum of claim 1, wherein the slots extend in an axial direction.

3. The ladder drum of claim 2, wherein the main body comprises an inner body and an outer body, the inner body having axial ends and an axially extending bore adapted to receive the blind tilt shaft; a web extending radially from the inner body to the outer body extending around a first portion of the inner body and defining a central region, a first side and a second side; and a substantially planar surface extending between the first side and second side, wherein the web includes openings adjacent the first side and second side of the planar surface.

4. The ladder drum of claim 3, wherein each first slot is a wide slot that includes an oval-shaped portion located near the first slot in a central region of the planar surface contiguous with an axial extending tapered open portion.

5. The ladder drum of claim 4, wherein the tapered open portion of the wide slot is narrower than the oval portion and is sized to retain a cord in the wide slot.

6. The ladder drum of claim 5, wherein the second slot is a narrow slot that includes an oval-shaped portion sized to grip the cord.

7. The ladder drum of claim 6, wherein the narrow slot further includes an axial extending tapered open portion contiguous with the narrow slot and sized to allow the cord to enter the narrow slot.

8. The ladder drum of claim 1, wherein the ladder lace cords have a substantially constant thickness.

9. The ladder drum of claim 1, wherein the main body is adapted for engagement with an elongate tilt shaft, the main body including an axis extending substantially parallel to the tilt shaft and wherein the first and second slot are axially spaced from each other.

10. A venetian blind assembly including the tilt drum roller of claim 1.

11. A ladder drum for securing venetian blind ladder lace cords comprising:

a main body having a bore therethrough for receiving a blind tilt shaft;

means for retaining the ladder lace cords formed in the main body, wherein said means for retaining the ladder lace cords is configured to route the cords through the means for retaining and does not require contact with the tilt shaft to hold the cords to the drum.

12. The ladder drum of claim 11, wherein the means for retaining the ladder lace cords includes at least a pair of spaced apart slots in the main body, the pair of slots adapted to secure a ladder lace cord and including a wide slot for retaining one of the cords without gripping the cord and a narrow slot spaced apart from the wide slot and sized to grip the cord.

13. The ladder drum of claim 12, wherein each wide slot includes an oval-shaped portion contiguous with an axial extending tapered open portion.

14. The ladder drum of claim 13, wherein the tapered open portion of the wide slot is narrower than the oval portion and is sized to retain a cord in the wide slot.

15. The ladder drum of claim 14, wherein the narrow slot includes an oval-shaped portion sized to grip the cord.

16. The ladder drum of claim 15, wherein the narrow slot further includes an axial extending tapered open portion contiguous with the narrow slot and sized to allow the cord to enter the narrow slot.

17. A venetian blind comprising:

a longitudinally extending headrail for supporting the blind;

a drum support attached to the headrail having two spaced apart walls for supporting a ladder drum;

a ladder drum mounted on said drum support;

a ladder including two vertically orientated cords attached to the drum so that the cords extend downwardly from the ladder drum and rungs extend between the ladder cords to support slats of the blind; and an axially extending tilt shaft disposed such that rotation of the shaft rotates the drum, causing one of the ladder cords to be raised and the other ladder cord to be lowered from a neutral position, said ladder drum having a bore adapted to receive the tilt shaft and a pair of slots adapted to grip a first or second ladder cord and each pair of slots including a first slot for retaining one of the cords without gripping the cord and a second slot spaced apart from the first slot and sized to grip the cord, the slots being configured to route the cord through the slots to lock the cord in place without contacting the tilt shaft.

18. The venetian blind of claim 17, wherein the ladder drum is formed from a unitary element including an inner body and an outer body, the inner body having axial ends and the bore adapted to receive a blind tilt shaft.

19. The venetian blind of claim 18, the ladder drum further including a web extending from the inner body to an outer body extending around a first portion of the inner body and defining a first side and a second side.

20. The venetian blind of claim 19, wherein the ladder drum further includes a substantially planar surface extending between the first side and second side having the slots defined therein.

21. The venetian blind of claim 20, wherein the pair of slots extends in an axial direction.

22. The venetian blind of claim 21, wherein the web includes openings adjacent the first side and second side of the planar surface.

23. The venetian blind of claim 22, wherein the first slot is a wide slot that includes an oval-shaped portion located near the central region of the planar surface contiguous with an axially extending tapered opening.

24. The venetian blind of claim 23, wherein the second slot is a narrow slot including an oval-shaped portion sized to grip the cord and an axially extending tapered opening sized to allow the cord to enter the narrow slot.

25. The ladder drum of claim 17, wherein the ladder lace cords have a substantially constant thickness.

26. The ladder drum of claim 17, wherein the main body is adapted for engagement with the tilt shaft, the ladder drum including a main body including an axis extending substantially parallel to the tilt shaft and wherein the first and second slot are axially spaced from each other.

27. A method of assembling a venetian blind comprising:

providing a longitudinally extending headrail for supporting the blind;

mounting a ladder drum support to the headrail, the ladder drum support having two spaced apart walls for supporting a ladder drum, mounting a ladder drum to said support, the ladder drum having a pair of slots and a bore adapted to receive the tilt shaft, each pair of slots adapted to grip a first or second ladder cord and each pair of slots including a first slot for retaining one of the cords without gripping the cord and a second slot spaced apart from the first slot and sized to grip the cord;

inserting an axially extending tilt shaft through a bore in a central portion of the ladder drum, such that rotation of the shaft rotates the drum, causing one of the ladder cords to be raised and the other ladder cord to be lowered from a neutral position; and providing a ladder including two vertically orientated cords and rungs extending between the ladder cords to support slats of the blind and attaching the cords to the drum so that the cords extend downwardly from the ladder drum and are routed through the slots so that the pair of slots locks the cord to the ladder drum without contacting the tilt shaft.

28. The method of claim 27, wherein each cord is fastened to the drum by placing an end of the cord in the first slot, moving the drum with respect to the cord to position the cord on the drum, and securing the cord to the drum by disposing the cord in the second, cord gripping slot.

29. The method of claim 28, wherein the ladder drum is formed from a unitary element including an inner body and an outer body, the inner body having a bore adapted to receive the blind tilt shaft.

30. The method of claim 29, the ladder drum further including a web extending from the inner body to an outer body extending around a first portion of the inner body and defining a first side and a second side.

31. The method of claim 30, wherein the web includes openings adjacent the first side and second side of the planar surface.

32. The method of claim 31, wherein the first slot is a wide slot and the second slot is a narrow slot and each cord is secured to the drum by placing an end of the cord in the wide slot, threading the cord through an opening in the web, and securing the cord to the drum by disposing the cord in the narrow, cord gripping slot.

33. The ladder drum of claim 27, wherein the ladder lace cords have a substantially constant thickness.

34. The ladder dram of claim 27, wherein the main body is adapted for engagement with the tilt shaft, the ladder drum including a main body including an axis extending substantially parallel to the tilt shaft and wherein the first and second slot are axially spaced from each other.

* * * * *

UNITED STATES PATENT AND TRADEMARK OFFICE

CERTIFICATE OF CORRECTION

PATENT NO. : 6,976,522 B2
APPLICATION NO. : 10/442378
DATED : December 20, 2005
INVENTOR(S) : Toralf H. Strand It is certified that error appears in the above-identified patent and that said Letters Patent is hereby corrected as shown below:

Column 5, line 17 to Column 8 line 29, please delete the claims in their entirety and replace them with the following:

Claim 1. A device for securing Venetian blind ladder lace cords comprising:

a blind tilt shaft;

a ladder drum including a unitary main body adapted to receive the blind tilt shaft and a pair of slots in the main body, the pair of slots adapted to secure a ladder lace cord and the pair of slots including a first slot for retaining one of the cords without gripping the cord and a second slot spaced apart from the first slot and sized to grip the cord, the slots being configured to route the cord through the slots and to lock the cord to the drum without contacting the tilt shaft.

Claim 2. The device of claim 1, wherein the slots extend in an axial direction.

Claim 3. The device of claim 2, wherein the main body comprises an inner body and an outer body, the inner body having axial ends and an axially extending bore adapted to receive the blind tilt shaft; a web extending radially from the inner body to the outer body extending around a first portion of the inner body and defining a central region, a first side and a second side; and a substantially planar surface extending between the first side and second side, wherein the web includes openings adjacent the first side and second side of the planar surface.

Claim 4. The device of claim 3, wherein each first slot is a wide slot that includes an oval -shaped portion located near the first slot in a central region of the planar surface contiguous with an axial extending tapered open portion.

Claim 5. The device of claim 4, wherein the tapered open portion of the wide slot is narrower than the oval portion and is sized to retain a cord in the wide slot.

Signed and Sealed this

Fourteenth Day of September, 2010

David J. Kappos

David J. Kappos
*Director of the United States Patent and Trademark Office*

Claim 6. The device of claim 5, wherein the second slot is a narrow slot that includes an oval-shaped portion sized to grip the cord.

Claim 7. The device of claim 6, wherein the narrow slot further includes an axial extending tapered open portion contiguous with the narrow slot and sized to allow the cord to enter the narrow slot.

Claim 8. A venetian blind assembly including the device of claim 1.

Claim 9. A device for securing venetian blind ladder lace cords comprising:

a blind tilt shaft;

a main body having a bore therethrough for receiving the blind tilt shaft;

means for retaining the ladder lace cords formed in the main body, wherein said means for retaining the ladder lace cords is configured to route the cords through the means for retaining and does not require contact with the tilt shaft to hold the cords to the drum.

Claim 10. The device of claim 9, wherein the means for retaining the ladder lace cords includes at least a pair of spaced apart slots in the main body, the pair of slots adapted to secure a ladder lace cord and including a wide slot for retaining one of the cords without gripping the cord and a narrow slot spaced apart from the wide slot and sized to grip the cord.

Claim 11. The device of claim 10, wherein each wide slot includes an oval-shaped portion contiguous with an axial extending tapered open portion.

Claim 12. The device of claim 11, wherein the tapered open portion of the wide slot is narrower than the oval portion and is sized to retain a cord in the wide slot.

Claim 13. The device of claim 12, wherein the narrow slot includes an oval-shaped portion sized to grip the cord.

Claim 14. The device of claim 13, wherein the narrow slot further includes an axial extending tapered open portion contiguous with the narrow slot and sized to allow the cord to enter the narrow slot.

Claim 15. A venetian comprising:

a longitudinally extending headrail for supporting the blind;

a drum support attached to the headrail having two spaced apart walls for supporting a ladder drum;

a ladder drum mounted on said drum support;

a ladder including two vertically orientated cords attached to the drum so that the cords extend downwardly from the ladder drum and rungs extend between the ladder cords to support slats of the blind; and an axially extending tilt shaft disposed such that rotation of the shaft rotates the drum, causing one of the ladder cords to be raised and the other ladder cord to be lowered from a neutral position, said ladder drum having a bore adapted to receive the tilt shaft and a pair of slots adapted to grip a first or second ladder cord and each pair of slots including a first slot for retaining one of the cords without gripping the cord and a second slot spaced apart from the first slot and sized to grip the cord, the slots being configured to route the cord through the slots to lock the cord in place without contacting the tilt shaft.

Claim 16. The venetian blind of claim 15, wherein the ladder drum is formed from a unitary element including an inner body and an outer body, the inner body having axial ends and the bore adapted to receive a blind tilt shaft.

Claim 17. The venetian blind of claim 16, the ladder drum further including a web extending from the inner body to an outer body extending around a first portion of the inner body and defining a first side and a second side.

Claim 18. The venetian blind of claim 17, wherein the ladder drum further includes a substantially planar surface extending between the first side and second side having the slots defined therein.

Claim 19. The venetian blind of claim 18, wherein the pair of slots extends in an axial direction.

Claim 20. The venetian bind of claim 19, wherein the web includes openings adjacent the first side and second side of the planar surface.

Claim 21. The venetian blind of claim 20, wherein the first slot is a wide slot that includes an oval-shaped portion located near the central region of the planar surface contiguous with an axially extending tapered opening.

Claim 22. The venetian blind of claim 21, wherein the second slot is a narrow slot including an oval-shaped portion sized to grip the cord and an axially extending tapered opening sized to allow the cord to enter the narrow slot.

Claim 23. A method of assembling a venetian blind comprising:

providing a longitudinally extending headrail for supporting the blind;

mounting a ladder drum support to the headrail, the ladder drum support having two spaced apart walls for supporting a ladder drum, mounting a ladder drum to said support, the ladder drum having a pair of slots and a bore adapted to receive the tilt shaft, each pair of slots adapted to grip a first or second ladder cord and each pair of slots including a first slot for retaining one of the cords without gripping the cord and a second slot spaced apart from the first slot and sized to grip the cord;

inserting an axially extending tilt shaft through a bore in a central portion of the ladder drum, such that rotation of the shaft rotates the drum, causing one of the ladder cords to be raised and the other ladder cord to be lowered from a neutral position; and providing a ladder including two vertically orientated cords and rungs extending between the ladder cords to support slats of the blind and attaching the cords to the drum so that the cords extend downwardly from the ladder drum and are routed through the slots so that the pair of slots locks the cord to the ladder drum without contacting the tilt shaft.

Claim 24. The method of claim 23, wherein each cord is fastened to the drum by placing an end of the cord in the first slot, moving the drum with respect to the cord to position the cord on the drum, and securing the cord to the drum by disposing the cord in the second, cord gripping slot.

Claim 25. The method of claim 24, wherein the ladder drum is formed from a unitary element including an inner body and an outer body, the inner body having a bore adapted to receive the blind tilt shaft.

Claim 26. The method of claim 25, the ladder drum further including a web extending from the inner body to an outer body extending around a first portion of the inner body and defining a first side and a second side.

Claim 27. The method of claim 26, wherein the web includes openings adjacent the first side and second side of the planar surface.

Claim 28. The method of claim 27, wherein the first slot is a wide slot and the second slot is a narrow slot and each cord is secured to the drum by placing an end of the cord in the wide slot, threading the cord through an opening in the web, and securing the cord to the drum by disposing the cord in the narrow, cord gripping slot.

Claim 29. The device of claim 1, wherein the ladder lace cords have a substantially constant thickness.

Claim 30. The device of claim 1, wherein the main body is adapted for engagement with an elongate tilt shaft, the main body including an axis extending substantially parallel to the tilt shaft and wherein the first and second slot are axially spaced from each other.

Claim 31. The venetian blind of claim 15, wherein the ladder lace cords have a substantially constant thickness.

Claim 32. The venetian blind of claim 15, wherein the main body is adapted for engagement with the tilt shaft, the ladder drum including a main body including an axis extending substantially parallel to the tilt shaft and wherein the first and second slot are axially spaced from each other.

Claim 33. The method of claim 23, wherein the ladder lace cords have a substantially constant thickness.

Claim 34. The method of claim 23, wherein the main body is adapted for engagement with the tilt shaft, the ladder drum including a main body including an axis extending substantially parallel to the tilt shaft and wherein the first and second slot are axially spaced from each other.